United States Patent [19]

Clevinger

[11] Patent Number: 4,632,002

[45] Date of Patent: Dec. 30, 1986

[54] RIGIDLY CONSTRUCTED PORTABLE ELECTRIC DOUBLE BASS

[76] Inventor: Martin R. Clevinger, 5410 Telegraph Ave., Oakland, Calif. 94609

[21] Appl. No.: 446,557

[22] Filed: Dec. 3, 1982

[51] Int. Cl.[4] ..... G10H 3/00

[52] U.S. Cl. ..... 84/1.16; 84/1.14; 84/DIG. 24; 84/291

[58] Field of Search ..... 84/1.14, 1.16, DIG. 24, 84/1.15, 291

[56] References Cited

U.S. PATENT DOCUMENTS

| | | | |
|---|---|---|---|
| 3,113,990 | 12/1963 | Zanessi | 84/DIG. 24 |
| 3,325,580 | 6/1967 | Barcus et al. | 84/1.16 |
| 3,538,807 | 11/1970 | Francis | 84/267 |
| 3,691,285 | 9/1972 | Larrison | 84/1.16 |
| 3,769,871 | 11/1973 | Cawthorn | 84/291 |
| 3,833,751 | 9/1974 | Chapman | 84/1.16 |
| 4,147,084 | 4/1979 | Underwood | 84/1.16 |
| 4,149,442 | 4/1979 | Boshco | 84/1.15 |
| 4,192,213 | 3/1980 | Steinberger | 84/293 |
| 4,235,143 | 11/1980 | Hoexter | 84/1.16 |
| 4,242,938 | 1/1981 | Van Zalinge | 84/1.16 |
| 4,254,683 | 3/1981 | Nulman | 84/1.15 |

*Primary Examiner*—Forester W. Isen

*Attorney, Agent, or Firm*—Townsend and Townsend

[57] ABSTRACT

An improved, easily-transportable, electric double bass viol having a non-resonant body and rigidly supported fingerboard for enhanced string sustain and tonal brilliance, collapsible body extensions for providing the customary physical dimension and reference points found in traditional double basses to render the instrument easily playable by bassists trained on traditional double basses, and a piezoelectric bridge pickup structure having a piezoelectric element and flexible and inflexible portions such that string motion is transmitted to the piezoelectric element while acoustic energy in the body is substantially prevented from exciting the piezoelectric element, thereby eliminating unwanted acoustic feedback, while providing a tonal characteristic similar to an acoustic double bass.

20 Claims, 14 Drawing Figures

RIGIDLY CONSTRUCTED PORTABLE ELECTRIC DOUBLE BASS

DESCRIPTION

Background Art

The present invention relates generally to improvements in string musical instruments and, more particularly, to an easily transportable electric double bass viol with sonic properties more adaptable to varied musical environments than double basses of the prior art.

The invention can be applied to various bowable string instruments such as cellos, violones and other like string instruments; however, the invention is particularly advantageous when applied to an instrument such as the double bass. Thus, the double bass will be used as an illustrative example of the invention.

Electric double basses have been tried in the past, but none have ever achieved widespread acceptance or commercial success. Most of the prior art electric double basses employed hollow or semi-hollow bodies of fiberglass and later, plywood. These non-rigid acoustically lossy bodies, combined with unsatisfactory electric pickup means produced poor tone. One prior art instrument employed a solid body which did not attempt to reduce unwanted resonances. This prior art instrument employed an acoustically lossy bridge assembly of metal construction which caused rattles and unwanted resonances. Due to physical design difficulties, this instrument was almost impossible for a double bassist to play. Another prior art instrument employed a non-rigid detachable neck portion with a full sized scrolled head. There are other prior art double basses which attempt to duplicate the tone of the acoustic double bass by means of hollow or resonant acoustic bodies of non-rigid construction. These non-rigid instruments, however, are feedback prone and suffer from limited tonal variation and decreased brilliance of tone and string sustain.

Additionally, the overall length of these instruments has not been significantly reduced; thus, they are not much more easily transportable than the traditional acoustic double bass. The prior art designs which incorporate thin wood, plywood or laminated construction are very easily damaged and are adversely affected by temperature and humidity change. Those prior art double basses which achieve portability through disassembly of the neck or other major members are inconvenient due to set-up time and cannot be as rigid as integral designs. Those prior art instruments with removable necks cause permanent string damage when disassembled, and those which have no shoulders on both sides of the body are disorienting to the trained double bassist.

Prior art designs which are based upon 19th Century mute double basses are known. Solid body mute basses were originally intended for silent music practice and do not include design features which are necessary for brilliant tone and sustain of all notes, or for the effective control of electric pickup means to produce a wide variety of tonal characteristics. Commercially available electrical pickup means of the type intended to be removably mounted on acoustic instruments have been mounted on mute double basses using standard bridges designed for use with standard acoustical instruments; the resultant tonal quality being uneven and generally unsatisfactory. The mute double basses employ a standard tail piece, bridge and neck structure, which is cumbersome and easily broken in transport, and which is acoustically lossy.

The prior art electric double basses have incorporated only single electric pickup means. Sometimes magnetic pickup coils have been used in various configurations operatively associated with the bridge and sometimes the strings. Other prior art double basses have employed piezoelectric pickups operatively associated with the bridge and resonant body designs. These single electric pickup means have limited the tonal variations available in the electric double basses of the prior art. The shortcomings of the prior art electric double basses have been substantially eliminated by the present invention.

SUMMARY OF THE INVENTION

It is an object of the invention to provide a rigidly constructed bowable string instrument with a substantially non-resonant body. The invention substantially eliminates resonances and flexing in all parts where these effects are detrimental to even response and brilliant sustaining tone. As an added benefit, the present string instrument is not susceptable to acoustic feedback problems associated with prior art string instruments which require acoustic motion in their bodies to obtain a usable audio signal.

Another object is to provide a specially designed bridge pickup means which is able to produce a tonal quality which has previously been possible only in instruments with resonant acoustic bodies. The present invention now enables this tonal quality to be obtained from a rigid non-resonant bodied string instrument with all its advantages.

Another object of the invention is to provide a transducer and control configuration which allows the player to obtain a great variety of tonal qualities.

It is a further object of the invention to minimize overall dimensions of the instrument without changing the standard playing dimensions of the instrument and without requiring disassembly of the string supporting portions of the instrument for portability.

Yet, another object of the invention is to provide an electric double bass which is economical, durable, weather resistant, and offers the same balance and feel of the acoustic double bass. As an added benefit, the volume level produced by the invention is totally controllable, ranging from inaudible to as loud a level as the connected musical instrument amplifier is capable of providing.

The present invention provides the balance and feel of the standard acoustic double bass by means of a special body extension system including two collapsible pieces which enable the present invention to balance and rest against the bassist's body just as a conventional double bass would. In the right upper back of the body, a collapsible extension means is shaped to duplicate the portion of the traditional acoustic double bass that contacts the bassist's body in the playing position. In the lower end of the body of the present invention, a unique folding extension piece provides the standard playing height and angle of the acoustic double bass. In the playing position, the folding extension piece is preferably pitched at a fifteen to twenty degree angle relative to the plane of the body and operates less satisfactorily at other angles between ten and thirty degrees.

This angle places the free end of the extension very close to the location of the endpin of a traditional acoustic double bass. At the free end of the folding extension piece is a telescoping endpin which features a non-slip rubber pad for preventing rotational motion of the instrument. Thus, the invention is immediately playable and comfortable to anyone familiar with the traditional acoustic double bass.

In the present invention, the neck and body act as one rigid unit; this is necessary for billiant tone and long string sustain. The materials used in the construction of the neck and body should be rigid and substantially non-resonant. These requirements can be adequately met using hard rock maple, as an example. It is possible to construct the invention with any materials that meet the above requirements, should such materials become available.

There is very little flexing or energy loss in the neck or body when the strings are vibrating. This is due in part to the massive size of the neck and body joint. This joint runs from the heel of the neck to just short of the end of the fingerboard. In the prior art, half of the fingerboard is left unsupported; also, the neck to body joint is small, ending just two or three inches into the body. It has been discovered that the flexing and energy absorption resulting from such a structure causes diminished brilliance of tone and string sustain. The neck in the present invention is continuous under a substantial length of the fingerboard to support the fingerboard. The supported fingerboard greatly enhances sustain of the notes in the upper register and provides even response from all notes. These benefits are the result of elimination of flexing as found in the unsupported fingerboard of prior art string instruments. Additionally, the unwanted resonance introduced by vibrating unsupported fingerboards has been eliminated.

Moreover, the additional mass provided by the large neck and body joint greatly reduces the acoustic losses in the system. In pizzicato playing of the double bass, the bassist must have a portion of the underside of the fingerboard available to place the thumb of the plucking hand. The present invention provides for this by rigidly supporting the fingerboard in a plane above the plane of the top surface of the body, and allowing a small portion of the supported fingerboard to overhang the supporting neck on both sides and the end closest to the plucking area.

The body and neck of the present invention are designed to reduce overall dimensions without sacrificing the tactile and visual references a trained double bassist requires for ease of performance. Among these tactile and visual references are: the point at which the neck joins the body, referred to in the art as the shoulder of the instrument, and the point at which the neck joins the head. The present invention provides shoulders at the point where the neck joins the body and a peg box heel at the point where the neck joins the head. Thus, as the double bassist plays up and down the neck the provided familiar reference points enable the use of standard playing technique.

The large scrolled head of the conventional double bass has been eliminated and a head just large enough to accommodate standard bass guitar tuning gears is provided. The bass guitar tuning gears are preferred because the space they require is half that of standard double bass tuning gears. The head keeps the tuning gears in their familiar location, thus enabling the bassist to tune with the bow or tune during performance.

In the present invention the familiar tailpiece is eliminated. Instead of anchoring the strings to the tailpiece, the strings are anchored to the body itself. As an added benefit, a more rigid coupling between the body and strings results. This enhances the sustain of the plucked string, as acoustic energy losses in the tailpiece are eliminated. The present body design reduces the overall length of the instrument by approximately eighteen inches.

The present invention incorporates two types of electric pickup means: a magnetic string pickup and a piezoelectric bridge pickup system which has been designed to produce tonality similar to instruments which rely upon resonant acoustic bodies. This is accomplished without inducing significant acoustic motion in the body or the body members. Thus, all of the drawbacks associated with resonant acoustic bodies have been substantially eliminated. The present invention makes possible a rigid body instrument, with all its advantages, capable of producing a tonal quality similar to the acoustic double bass.

In normal operation, a piezoelectric crystal element must have large stresses applied either by leverage or inertia. This occurs when a piezoelectric crystal is coupled to the moving members of a vibrating acoustic string instrument. In the past, it has not been possible to obtain a satisfactory audio signal output from piezoelectric crystals when attempting to couple to substantially rigid non-resonant bodies, as the vibrating strings were unable to transmit sufficient physical motion to the piezoelectric crystal element.

The present invention overcomes the problems of the prior art by generating the audio signal in a bridge transducer system which is not intended to actuate motion in a resonant body or vibrateable body plate. Instead, this piezoelectric bridge pickup is substantially decoupled from the influences of acoustic phenomenon occurring in the body. The vibrating strings are unable to induce appreciable motion in the rigid and large-mass body elements of the present invention, most of the acoustical energy being confined to the strings and the bridge transducer system. In this way maximum sustain and brilliance of tone are achieved.

A special flexible bridge has been designed to transmit acoustic energy to a central point where the acoustic energy is summed and transmitted to the drive point of a very efficient piezoelectric element, such as a ceramic bimorph crystal element. The piezoelectric bimorph element is preferred because its electrical characteristics enable its output signal to be passively mixed with the output signal of the magnetic pickup, as their output levels and impedances are reasonable compatible.

The magnetic pickup is of known kind which consists of a coil and a magnetic field operatively associated with the strings, provides an audio signal of a completely different character than that of the piezoelectric bridge pickup. The signal of the magnetic pickup contains information based on the eliptical precession of the vibrating strings in the area where the magnetic field is perturbed by the moving string. The tonality of this type of pickup is not as complex as that of mechanically coupled systems. This tonal quality of the magnetic pickup is very defined and present, being clearly audible under noisy ambient conditions. Mixing the signal outputs of both pickups provides a tonal quality superior to that available in the prior art. A switching and control circuit is provided which enables the bassist to select either the magnetic string pickup, the piezoelectric bridge pickup or the combined pickups. The control circuit includes a tone control(s) and a volume control. With these options, an unlimited variety of tonal colors or characteristics is available. Thus, the invention enables the double bassist to effectively deal with almost any performing situation.

Although such novel features believed to be characteristic of the invention are pointed out in the claims, the invention and manner in which it may be carried out may be further understood by reference to the following description and the accompanying drawings.

DESCRIPTION OF THE PREFERRED EMBODIMENT

Referring now to the figures in greater detail, where like reference numbers denote like parts in the various figures: the present invention will be described by way of an illustrative example using a double bass.

Figure 1:
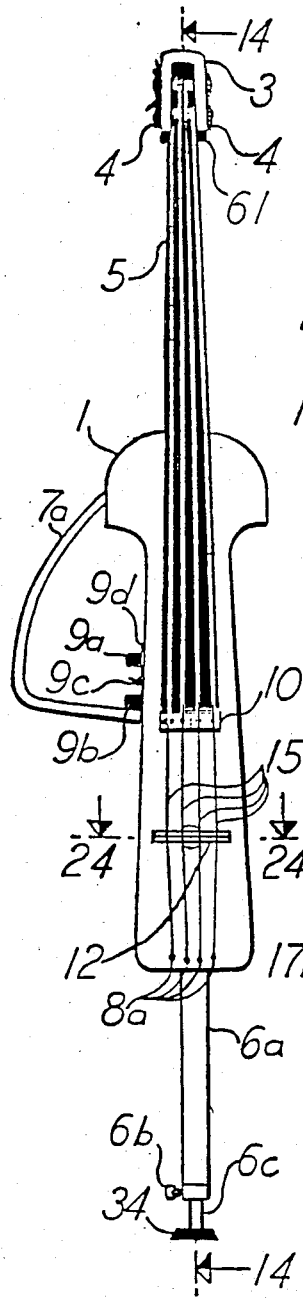
FIG. 1 is a front elevational view illustrating a string instrument embodying the principals of the invention.
Figure 2:
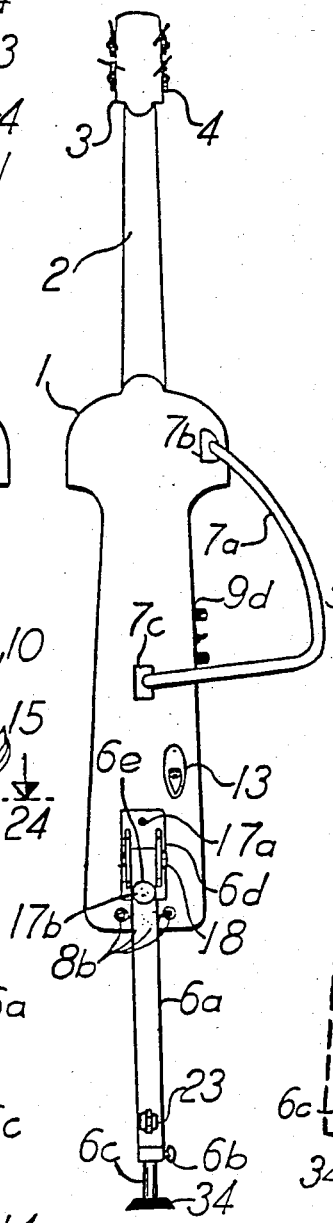
FIG. 2 is a back elevational view of the same.

In FIGS. 1 and 2, there is shown a double bass constructed in accordance with the present invention, including a body 1, and an elongated slightly tapered neck portion 2 attached to and extending longitudinally outward therefrom. The neck portion 2 has a fingerboard 5 mounted thereon and includes a head 3 at the end opposite the body 1. Mounted on the head 3 are the tuning gears 4. Conventional tuning gears may be mounted in a manner well-known to those skilled in the art and will, therefore, not be discussed in detail. A plurality of playing strings 15 are threaded through the string ferrules *8b* on the back of the body, pass through the body 1, and exit through string bushings *8a*. It will be clearly understood that the number of strings arranged along the neck and body portions depends on whether four, five or other type string arrangement is desired. Since the preferred embodiment according to the present invention is directed to an electric four string double bass, four strings have been illustrated as seen clearly in FIG. 1.

The present string musical instrument further includes a piezoelectric bridge pickup 12, held against the body 1 by the tension of the strings 15 in a direction transverse to the longitudinal axis of the neck portion 2 and substantially equidistant from the end of the fingerboard 5 and string bushings *8a*.

Figure 5:
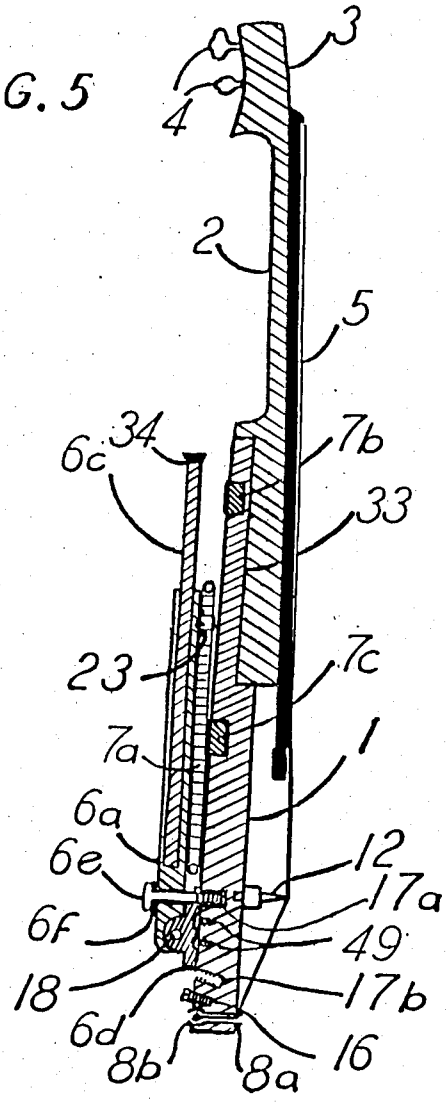
FIG. 5 is an enlarged cross-sectional view illustrating the present invention taken along line 14—14 and looking in the direction of the arrows.

Referring to FIG. 5, an important feature of the invention is that the neck to body joint 33 is substantially rigid, being much larger than the neck to body joints of the prior art, extending a significant distance along the body. The large rigid neck to body joint 33 is extremely durable due to its massive size and solid construction; this minimizes acoustic losses which cause diminished string sustain and loss of higher harmonics. This large neck joint also eliminates the flexing between the neck and body typically found in the prior art.

Figure 3:
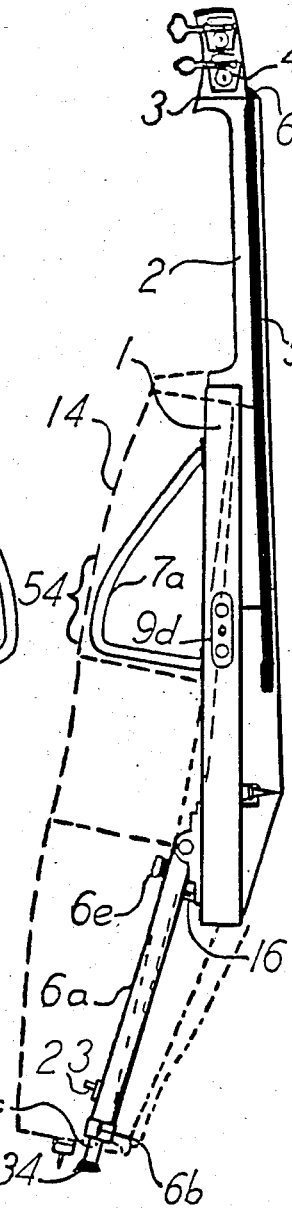
FIG. 3 is a side elevational view of FIG. 1.
Figure 4:
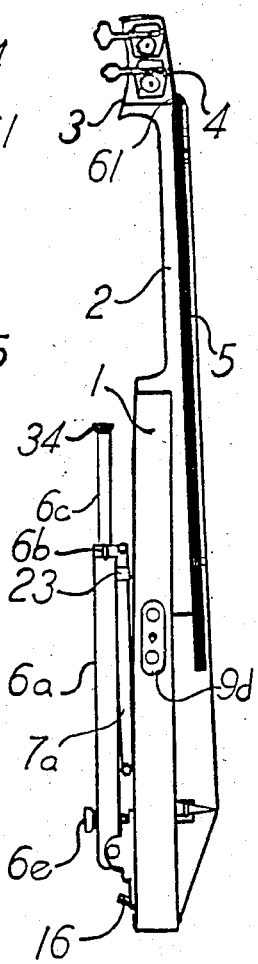
FIG. 4 is a side elevational view of FIG. 1 with the body extension means in the folded position.
Figure 9:
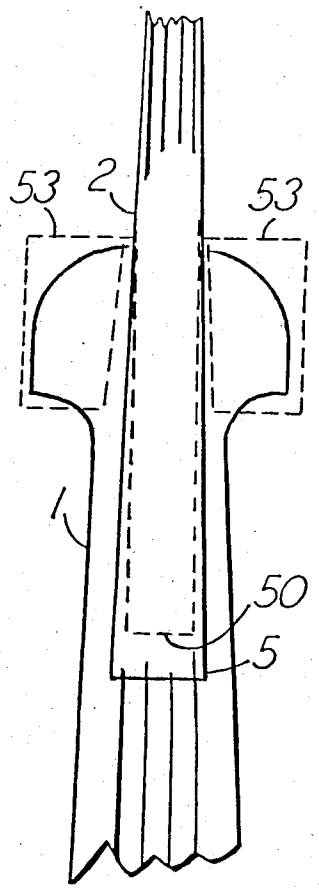
FIG. 9 is a fragmentary top view showing the supported fingerboard and the shoulders.

The fingerboard 5 is supported for a substantial portion of its length and width by the neck 2. As shown in FIGS. 5 and 9, the fingerboard is mounted in a plane above the plane of the top surface of the body. Typically, the distance between the fingerboard 5 and the top surface of the body is at least one inch. As can be seen in FIGS. 3 and 4, the strings are positioned at an angle with respect to the plane of the body. This string angle is due to the height of the bridge 12. In the preferred embodiment of the present invention, the bridge 12 is between three to four inches in height. Thus, the strings have greatest height, with respect to the plane of the body 1, at the bridge 12 and angle toward the plane of the body 1 as the head 3 is approached. In order to maintain the fingerboard 5 parallel with and in close proximity to the strings, the height of neck 2, with respect to body 1, increases toward the bridge 12.

Additionally, the fingerboard partially extends beyond the dimensions of the supporting neck 2 as shown by dotted line 50 in FIG. 9. In the plucking areas 9, the fingerboard 5 ends typically approximately two inches beyond the distal end of the supporting neck and at least one-half inch beyond the sides of the supporting neck 2. These features of the present invention eliminate flexing and vibrating of the fingerboard 5, thus providing increased brilliance and sustain from all notes on all strings. This is accomplished without sacrificing player access to the area on the underside of the fingerboard as required for pizzicato playing.

Figure 10:
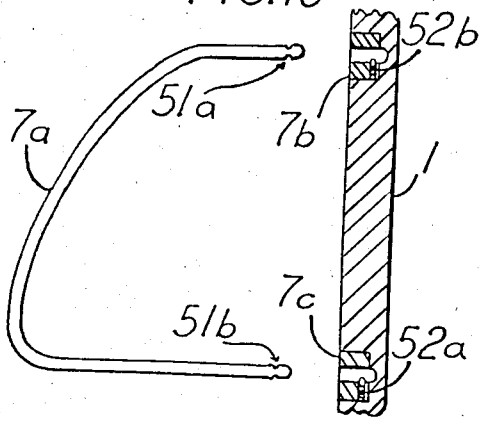
FIG. 10 is a fragmentary side view showing the upper bout extension *7a* and upper bout extension receptacles *7b* and *7c*.
Figure 7:
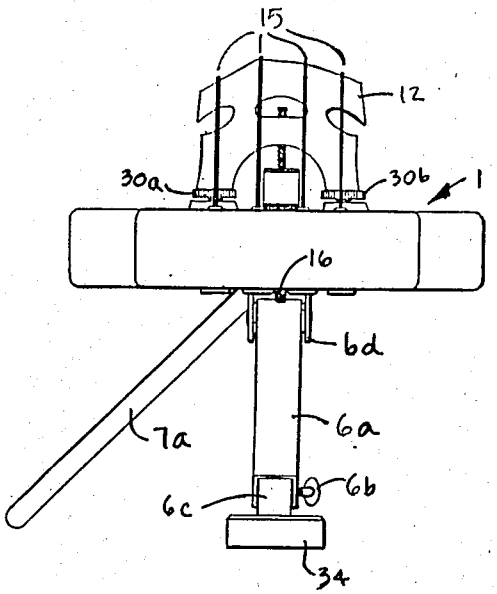
FIG. 7 is a bottom end view showing the body and the upper bout extension in the extended position.
Figure 13:
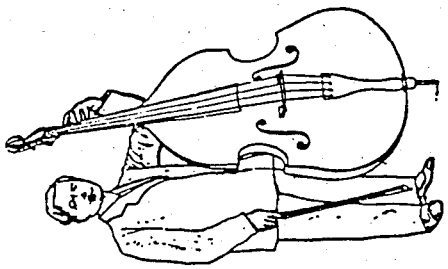
FIG. 13 shows the proper position of the bassist and the double bass at rest.
Figure 14:
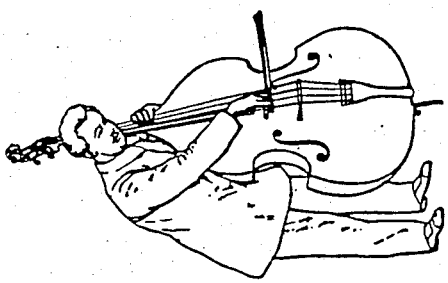
FIG. 14 shows the proper position of the bassist and bass in the playing position.

It is an important feature of the present invention that the double bassist find it readily playable. This is accomplished by providing the correct overall balance and player-to-instrument contact upper bout extension *7a* provides the proper player-to-instrument contact. As shown in FIG. 3, the upper bout extension substantially duplicates the shape of the portion of the back extremity 54 of the acoustic double bass as represented by dotted line 14. This extremity 54 contacts the players body in the proper playing position as shown in FIGS. 13 and 14. The upper bout extension *7a* is removably mounted on the back of the body portion 1 at, preferably, approximately a forty-five degree angle relative to the plane of the strings 15 and the body portion 1 as shown in FIG. 7. It is to be understood that an angle from 35 to 55 degrees can also be used with less satisfactory results. Referring to FIG. 10, the upper bout extension receptacle *7b* and *7c* are made of delrin or like material, and incorporate spring loaded balls *52a* and *52b* which removably engage detents *51a* and *51b* furnished in the free ends of the upper bout extention *7a*. Upper bout extention *7a* is preferably one piece and constructed from light weight, durable material, such as aluminum.

Referring to FIG. 9, shoulders 53 provide the necessary physical shape required by the player for finger position marking references.

Figure 11:
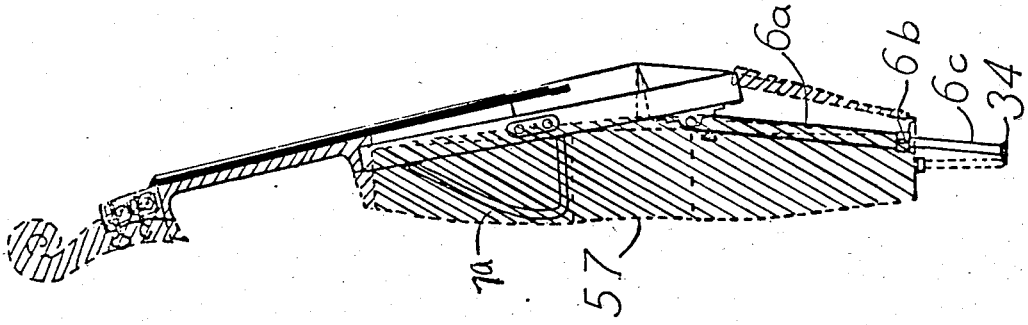
FIG. 11 is a side view of the invention superimposed on a traditional acoustic double bass.

As shown in FIGS. 3 and 11, the body extension 6a provides the proper playing height and angle and is adjustable to suit the user. The height of the present string instrument is adjusted by means of the telescoping endpin 6c which includes non-slip rubber pad 34 mounted on its free end. The non-slip rubber pad 34 prevents rotational movement of the instrument during performances. Thumb screw 6b provides locking means for the endpin 6c.

Referring now to FIGS. 2, 3, 4 and 5, the hinged body extension 6a when opened, provides the proper playing angle and height of the instrument, and when closed in the transportable position, holds the upper bout extension 7a by means of snap-on clip 23. Screw 16 provides an adjustable stand-off upon which the hinged body extension 6a rests when in the opened position. For larger angles between the body 1 and hinged body extension 6a, the screw 16 is rotated to increase its height. For smaller angles, the screw 16 is rotated into body 1. Referring to FIG. 5, the body extension locking screw 6e is removable from the hinged body extension 6a, and can be inserted in threaded receptacle 17a when locking the hinged body extension 6a in the transportable position.

Before playing the instrument, the body extension locking screw 6d is removed from the hinged body extension 6a and receptacle 17a. The hinged body extension 6a is then opened, and the body extension locking screw 6e is reinserted in the hinged body extension 6a and threaded receptacle 17b. The hinge pin 18 is kept noiseless and rattle free by means of compressible lock washers 56 shown in FIG. 7. Rubber washer 6f prevents the body extension locking screw 6e from vibrating or loosening while playing.

Figure 12:
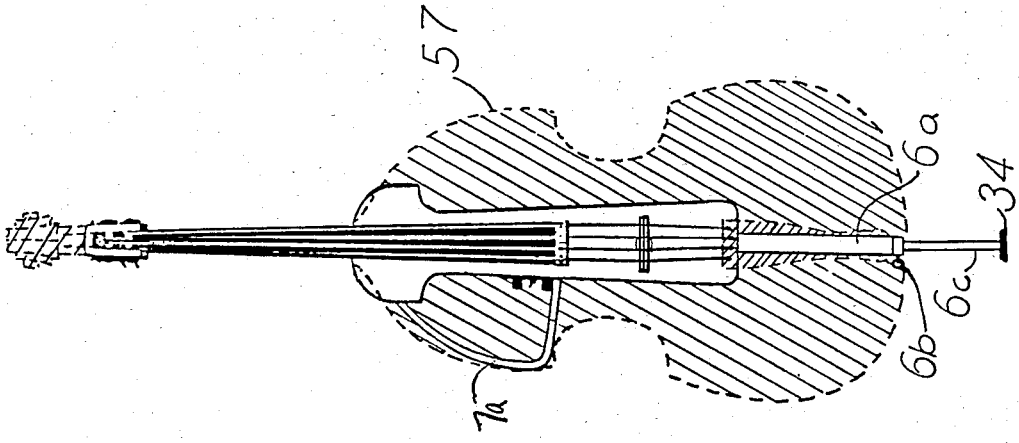
FIG. 12 is a front view of the invention superimposed on a traditional acoustic double bass.

Drawing FIGS. 11 and 12 show the present invention superimposed over the conventional acoustic double bass 57. It can be seen that the present invention provides, in a portable package, the playing features required by the bassist for ease of playing. These features include proper scale length, overall balance, proper player to instrument contact, and tactile as well as visual reference points.

Figure 6:
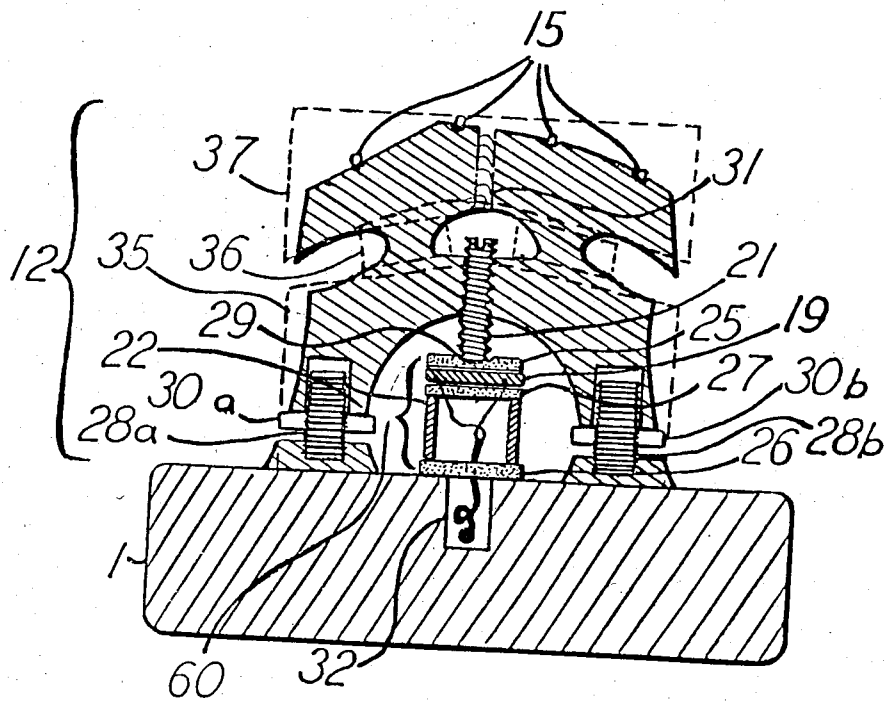
FIG. 6 is a cross-section view of the body 1 taken along line 24—24 of FIG. 1, and showing the parts of the piezoelectric pickup system 12.

Referring again to FIGS. 1 and 2, two different types of electric pickup means have been provided for maximum tonal variation. The magnetic pickup 10 of known type, senses the vibrational motion of the strings 15 within the magnetic field associated with this type of pickup. The sound produced in this manner is distinctly different than that produced by the piezoelectric bridge pickup 12. Now referring to FIG. 6, another important feature of the present invention is that the tonality produced by the piezoelectric bridge pickup 12 is similar in character to the tonality of the acoustic double bass. The piezoelectric bridge pickup 12 is a high compliance bridge structure much smaller and more flexible than prior art bridges. This makes possible the generation of a musically pleasing tone similar to that of acoustic instruments.

In the prior art, the bridge is intended to couple acoustic energy to the body or body members, the body or body members usually being yielding or flexible; thus, the prior art bridges are stiffer and incorporate designs which facilitate energy transfer of the moving strings to movable bodies. In the present invention, the body 1 and neck 2 of the instrument act as a substantially non-movable mass. The piezoelectric bridge transducer 12 is designed to conduct the motion of the vibrating strings to a summing point for conversion to alternating current electric signals which, when amplified through a loud speaker, provide a musical tonal character. This is made possible by shaping the parts of the piezoelectric bridge pickup 12 such that under the tensioned vibrating strings the distribution of acoustic energy is located in four general structures: The vibrating strings 15, the crown 37, the supporting arch 35 and the components of the suspended piezoelectric drum assembly 60. The acoustic energy does not appreciably excite body 1 and neck 2, which together act as an inertial mass of sufficient size, density and weight to reflect most of the acoustic energy back into the easily vibratable members of the system. Thus, the amount of acoustical energy loss is appreciably less than in prior art acoustic and semi-acoustic string instruments which of necessity dissipate appreciable amounts of acoustic energy. The amount of acoustic energy loss in a system limits the length of time the vibrating strings will sound before coming to rest. It is desirable characteristic for a string instrument to possess the quality of long duration of string sustain.

In the present invention, the crown 37 acts as a reasonably flat response compliant node which is much more easily displaced by the vibrations of the string 15 than the node at the other end of the string. This other node can be either the nut 61 or any node chosen by the player as when a note is "stopped" or fingered by the player by pressing a string against a point on the rigidly supported fingerboard 5. It has been seen in the present invention that most of the acoustic energy transfers through the easily vibratable high compliance crown 37 to the supporting pillars 36. The high compliance of the crown permits all dimensions of the string motion to be transferred to the rest of the pick-up. The supporting pillars are small enough to enable acoustic coupling from the crown to the supporting arch 35 without imposing excessive mechanical constraint on the crown 37. The motion in the supporting arch 35 responds to the sum of the multi-dimensional displacements of the crown 37 which are transmitted by the supporting pillars 36. For this reason, the drive stud 21 is preferably mounted in the center of the supporting arch.

The piezoelectric drum assembly 60 is suspended between the body 1 and the drive stud 21 by damping spacer 26 and 25, respectively. The drive stud 21 is acoustically coupled to and kept in contact with the piezoelectric drum assembly 60 solely by the slightly compressed resiliant material of the three damping spacers 25, 26 and 27. There is very little pressure involved in the coupling of the drive stud to the piezoelectric drum assembly 60. Typically this pressure is less than one kilogram per square centimeter at the drive point 29. Damping spacer 27 further damps the acoustic coupling between the piezoelectric bimorph element 19 and the piezoelectric bimorph element support means 22. The piezoelectric bimorph element support means 22 is preferably a hollow cylinder constructed of very low mass plastic, such as styrene or like material. The piezoelectric bimorph support means supports only the periphery of the disc shaped piezoelectric bimorph element.

The support means 22 and the damping spacers 25, 26 and 27 form a structure which itself is capable of imparting acoustical energy to the bimorph element 19. The damping spacers 17, 25 and 26 are both somewhat resilient and acoustically lossy. As such, the damping spacers 17, 25 and 26 are capable of storing energy when compressed. When motion in drive stud 21 causes damping spacer 25 to be compressed, thereby causing bimorph element 19 to be displaced, this displacement is also imparted to damping spacer 27. In turn, a portion of this displacement is imparted to support means 22 and thence to damping spacer 26. Each of the damping spacers 25, 26 and 27 stores a portion of this motional energy in accordance with the degree to which each is compressed. This stored energy is then released back to the system when each damping spacer springs back to its uncompressed state. This release of energy then imparts an inertia to support means 22 which causes motion in the bimorph element 19. The motion imparted to the bimorph element 19 is independent of any acoustical energy thereafter present on the drive stud 21. Thus, it can be seen that the piezoelectric drum assembly 60 resembles a mass suspended between several springs, such that energy can be stored therein in a form which alternates between kinetic energy, when the mass is in motion (bimorph element 19 and support means 22), and stored energy, when the springs are extended or compressed (the compressed damping spacers 25, 26 and 27). It is to be understood that the length of time over which this alternating transfer of acoustic energy will continue, after the initial motion of the drive stud 21 has gone away, is a function of the magnitude of the initial motion, the mass of the support means 22 and bimorph element 19, the resilience of the bimorph element 19 and the resilience of the material of damping spacers 25, 26 and 17, as well as the damping coefficients of the material of damping spacers 25, 26 and 27. This arrangement insures that maximum displacement of the piezoelectric bimorph element 19 occurs, as the drive stud 21 is coupled to the unsupported center drive point 29 of the piezoelectric bimorph element 19. The piezoelectric bimorph element 19 is a commercially available unit from Vernitron Piezoelectric and other manufacturers. The piezoelectric bimorph is chosen because of its high sensitivity and efficiency. The electrical characteristics of the piezoelectric bimorph element permit its use in association with magnetic pickups as the output level and impedance are reasonably well matched.

The piezoelectric bridge pickup 12 is equipped with height adjusting means comprising thumb wheels 30*a*, 30*b*, and studs 28*a*, 28*b*, thus enabling the user to adjust the playing action of the strings 15. The acoustic drive stud 21 is threaded and should be readjusted when the playing action is raised or lowered. This is accomplished by means of screwdriver access hole 31 which allows screwdriver adjustment of the acoustic drive stud 21.

The piezoelectric bridge pickup 12 does not transfer an appreciable amount of acoustic energy to the rigid body. Most of the acoustic energy is reflected back into the vibrating members of the instrument, which members are the strings and piezoelectric bridge pickup. This greatly enhances string sustain while eliminating feedback and spurious noise pickup.

Figure 8:
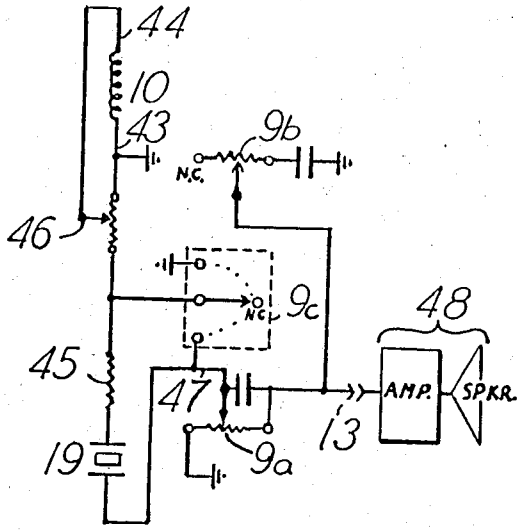
FIG. 8 is a schematic diagram of the electrical portion of the invention.

Referring to FIG. 8, the two distinctive sounds from the piezoelectric bridge pickup 12 and the magnetic pickup 10 are mixable or individually selectable by means of the three position pickup selector switch 9*c* as shown in FIG. 1. The two signal outputs of the different pickup means can be connected in series or parallel, but in the preferred embodiment, the signal outputs are switchably connected as shown in FIG. 8. In this manner, it is possible to avoid capacitance filtering of the high frequencies when both signal outputs are desired to be mixed simultaneously. If one lead of the piezoelectric bimorph element 19 was connected to ground, and its output lead connected serially through the magnetic pickup, the capacitance of the piezoelectric bimorph element would provide a signal path to ground for higher frequencies, thereby providing the undersirable effect of attenuating the higher frequency portion of the signal output. Referring to FIG. 8, one lead 43 of the magnetic pickup 10 is permanently connected to ground, its other lead 44 is connected serially through potentiometer 46 to the wiper of three position pickup selector switch 9*c* and loading resistor 45. Switch 9*c* enables the operator to select the output of the magnetic pickup 10, the piezoelectric bridge pickup 12 or a balanced mix of both pickups. Potentiometer 46 permits the operator to adjust the output level of the magnetic pickup 10. The selected output 47 is then connected to conventional tone and volume control circuitry. It is to be understood that the tone and volume control circuitry may include passive tone and volume controls as in the illustrative example shown in FIG. 8, or active tone and volume control both of which are well known to those skilled in the art. Volume control 9*a* variably attenuates the output signal from the pickup or frequency portion of the output signal. As shown in FIGS. 1 through 4, the control plate 9*d* is mounted on the side of the body 2 such that the controls are easily reached by the player's plucking hand. The output of the tone control circuitry is connected to output jack 13 for connection to a commercially available musical instrument amplifier and speaker 48.

By way of an example, a typical piezoelectric bridge 12 constructed from rock hard maple and in accordance with the present invention would preferably have the following dimensions: The overall height would be from three to four inches, and preferably three and one-half inches. The crown would have a height of approximately one-half to three-fourths of an inch, and a width of approximately four inches. The supporting arch 35 would have a width of approximately four inches. The supporting pillars would have a height, width and thickness of approximately one half inch. Overall, the thickness of the bridge would taper uniformly in thickness from approximately one-eighth of an inch at the top of crown 37 to approximately three-fourths of an inch at the base of supporting arch 35.

Configuring the bridge structure of the piezoelectric bridge pickup 12, as described above, further enhances the isolation of the bimorph element 19 from any acoustical energy present in body 1. As discussed above, body 1 and neck 2 are solid and of large mass such that the acoustical forces, normally present when the present invention is in use, are insufficient to overcome the force of inertia of the body and the neck and thereby too small to set the body and neck into motion to any significant degree. By tapering the bridge structure from a thick arch base to a thin crown, wherein the base of the arch 35 is relatively inflexible and rigid, whatever acoustical energy is present in the neck 2 and body 1 will be of too small a magnitude to appreciably excite the base of the arch and thereby to be transmitted up the arch 35 to the piezoelectric element 19. Conversely, the crown 37 and supporting pillars 36 are designed to be flexible and non-rigid to thereby permit acoustic energy from the strings to be transmitted to the piezoelectric element 19.

The terms and expressions which have been employed here are used as terms of description, and not of limitation, and there is no intention, in the use of such terms and expressions, of excluding equivalents of the features shown and described, or portions thereof. It being recognized that various modifications are possible within the scope of the invention claimed.

I claim:

1. A string musical instrument of the bowable type having a plurality of strings which are spaced apart and generally parallel to one another, each string having a vibratile length, wherein vibration is substantially confined to the strings when the strings are set into motion by bowing or plucking them, wherein the instrument is played in an upright position with one end resting on the floor, the instrument comprising a fingerboard which extends along a substantial portion of the strings so that different acoustical lengths of a selected string can be obtained when the selected string is "stopped" against the fingerboard at different points;

a substantially non-resonant body having rigidity to be resistant to the vibration imparted to a flexible bridge portion by the vibrating strings wherein the body further includes a solid body portion for supporting the neck means and the pickup means and extension means which are pivotably mounted to the solid body portion and which are pivotable between a first and a second position for supporting the solid body portion with respect to the floor when in the first position, and which are folded against the solid body position when in the second position; and neck means for supporting the fingerboard with respect to the strings and the body, wherein the neck means and the body are rigidly joined together over a substantial longitudinal distance, and further wherein the fingerboard extends along the entire neck means, so that substantially the entire length of the fingerboard is rigidly supported; and pickup means supported in the vicinity of the strings and adjacent the body for transforming the string motion into electrical signals including means for substantially isolating the pickup means from the body;

wherein the vibration is confined substantially to the strings and flexible bridge so that the string motion is sustained for a maximum period of time following bowing or plucking of the strings.

2. The apparatus of claim 1, wherein the extension means comprise an elongated first member;

an elongated second member which is telescopically coupled to one end of the first member; and coupling means fastened to the other end of the first member for pivotably mounting the first member to the solid body portion.

3. The apparatus of claim 2, wherein the extension means is positioned at an angle which is non-zero with respect to the plane of the solid body portion.

4. The apparatus of claim 3, wherein the angle is between 10 to 30 degrees.

5. The apparatus of claim 3, further including standoff means positioned between the body and the first member in the first position for adjusting the angle between the upper body portion and the extension means wherein the standoff means are adjustable in height so that the angle is correspondingly adjustable.

6. The apparatus of claim 2, wherein the coupling means is a hinge.

7. The apparatus of claim 2, further including foot means positioned on the free end of the second member for opposing rotation of the extension means with respect to the floor.

8. The apparatus of claim 7, wherein the foot means is a flexible, non-slip rubber pad.

9. The apparatus of claim 2 further including solid body extension means mounted to the solid body portion for providing a lateral contact surface to the user of the instrument at a predetermined position.

10. The apparatus of claim 9 wherein the solid body extension means protrudes from the solid body portion at a predetermined angle with respect to the plane of the solid body.

11. The apparatus of claim 10, wherein the angle at which the solid body extension means protrudes from the solid body portion is between 35 to 55 degrees.

12. The apparatus of claim 9, wherein the instrument is used as a double bass and furtherwherein the lateral contact surface provided by the solid body extension means is positioned to correspond to the portion which contacts the users body in a traditional acoustic double bass.

13. The apparatus of claim 12, wherein the solid body portion has a top surface and a back surface and the fingerboard and strings are positioned above the top surface, and furtherwherein the solid body extension means includes a tubular member having an upper and a lower leg, in which the lower leg is mounted toward the center of the back of the solid body portion and extends outwardly from the solid body portion in a horizontal manner, and in which the upper leg is mounted to the back of the solid body portion and above the lower leg, the upper leg extending downward toward the lower leg in a predetermined curve and thence joining the lower leg, so that the curve of the upper leg corresponds to the shape of the portion of the traditional acoustic double bass which contacts the user's body.

14. The apparatus of claim 9, wherein the solid body extension means is detachably mounted to the solid body portion.

15. A string musical instrument of the bowable type having a plurality of strings which are spaced apart and generally parallel to one another, each string having a vibratile length, wherein vibration is substantially confined to the strings when the strings are set into motion by bowing or plucking them, the instrument comprising a fingerboard which extends along a substantial portion of the strings so that different acoustical lengths of a selected string can be obtained when the selected string is "stopped" against the fingerboard at different points;

a substantially non-resonant body having sufficient rigidity as to be undisturbed by vibration imparted to the strings; and neck means for supporting the fingerboard with respect to the strings and the body, wherein the neck means and the body are rigidly joined together over a substantial longitudinal distance, and further wherein the fingerboard extends along the entire neck means, so that substantially the entire length of the fingerboard is rigidly supported; and pickup means supported in the vicinity of the strings and adjacent the body for transforming the string motion into electrical signals including means for substantially isolating the pickup means from the body;

wherein the acoustic energy is confined substantially to the strings so that the string motion is sustained for a maximum period of time following bowing or plucking of the strings;

wherein the pickup means include bridge pickup means which support the strings at a predetermined displacement from the body, the bridge pickup means comprising bridge body means positioned between the strings and the body for supporting the strings with respect to the body, the bridge body means having a substantially flexible portion which contacts the strings and a substantially inflexible portion which contacts the body so that the string motion is transmitted by the flexible portion of the bridge body means and so that vibration from the body is substantially prevented by the substantially inflexible portion from exciting the bridge body means;

transducer means communicatively coupled to the bridge body means for transforming the transmitted string motion into the electrical signals; and base means positioned on the body for supporting the transducer means relative to and for acoustically decoupling the transducer means from the body;

wherein the flexible bridge means include a crown portion shaped for contact with the strings;

an arch portion supported by the base means; and coupling members for coupling string motion from the crown portion to the arch portion, the coupling members having a predetermined thickness and density to support the crown portion on the arch portion and to minimize the mechanical constraint and so as to permit multi-dimensional string motion to be transferred between the crown portion and the arch portion, wherein the arch portion sums the acoustical energy transmitted through the coupling members; and wherein the transducer means include a drive stud which is coupled at one end to the arch portion;

a piezoelectric element which is supported by the base means for contact with the free end of the drive stud; so that the summed acoustical energy in the arch portion is coupled to the piezoelectric element by way of the drive stud.

16. The apparatus of claim 15, wherein the piezoelectric element is a disc-shaped bimorph element which is supported by the base means about its periphery, and in which the drive stud contacts the bimorph element toward the center of the bimorph element, and further-wherein the drive stud contacts the bimorph element with a predetermined amount of pressure, the pressure being determined by the base means.

17. The apparatus of claim 16, wherein the base means include bimorph support means comprising a support member shaped to support the bimorph element along the periphery of the bimorph element; and spacer means for supporting the bimorph element with respect to the drive stud and the support member, and for supporting the bimorph element with respect to the body, the spacer means having a predetermined resilience and damping coefficient so that partial compression of the spacer means provides the pressure by which the drive stud drives the bimorph element, and wherein acoustical energy from the drive stud is alternatively stored in the motion of the support member and in the compression of the spacer means.

18. The apparatus of claim 17, wherein the pressure provided by the partial compression is a small quantity less than one kilogram per square centimeter.

19. A string musical instrument of the bowable type having a pluraltiy of strings which are spaced apart and generally parallel to one another, each string having a vibratile length, wherein vibration is substantially confined to the strings when the strings are set into motion by bowing or plucking them, wherein the instrument is played in an upright position with one end resting on the floor, the instrument comprising:

a fingerboard which extends along a substantial portion of the strings so that different acoustical lengths of a selected string can be obtained when the selected string is "stopped" against the fingerboard at different points;

a substantially non-resonant body having rigidity to be resistant to the vibration imparted to a flexible bridge portion by the vibrating strings;

wherein the body further includes a solid body portion for supporting the neck means and the pickup means and extension means which are pivotally mounted to the solid body portion and which are pivotably between a first and a second position for supporting the solid body portion with respect to the floor when in the first position, and which are folded against the solid body portion when in the second position; and neck means for supporting the fingerboard with respect to the strings and the body, wherein the neck means and the body are rigidly joined together over a substantial longitudinal distance, and further wherein the fingerboard extends along the entire neck means, so that substantially the entire length of the fingerboard is rigidly supported.

20. A string musical instrument of the bowable type having a plurality of strings which are spaced apart and generally parallel to one another, each string having a vibratile length, wherein vibration is substantially confined to the strings when the strings are set into motion by bowing or plucking them, the instrument comprising:

a fingerboard which extends along a substantial portion of the strings so that different acoustical lengths of a selected string can be obtained when the selected string is "stopped" against the fingerboard at different points;

a substantially non-resonant body having sufficient ridigity as to be undisturbed by vibration imparted to the strings;

neck means for supporting the fingerboard with respect to the strings and the body, wherein the neck means and the body are rigidly joined together over a substantial longituding distance, and further wherein the fingerboard extends along the entire neck means, so that substantially the entire length of the fingerboard is rigidly supported; and wherein the vibration is confined substantially to the strings and flexible bridge so that the string motion is sustained for a maximum period of time following bowing or plucking of the strings;

wherein the pickup means include bridge pickup means which support the strings at a predetermined displacement from the body, the bridge pickup means comprising bridge body means positioned between the strings and the body for supporting the strings with respect to the body, the bridge body means having a substantially flexible portion which contacts the strings and a substantially inflexible portion which contacts the body;

transducer means communicatively coupled to the bridge body means for transforming the transmitted string motion into the electrical signals; and base means positioned on the body for supporting the transducer means relative to the body;

wherein the flexible bridge means include a crown portion shaped for contact with the strings;

an arch portion supported by the base means; and coupling members for coupling string motion from the crown portion to the arch portion, the coupling members having a predetermined thickness and density to support the crown portion on the arch portion and to minimize the mechanical constraint and so as to permit multi-dimensional string motion to be transferred between the crown portion and the arch portion, wherein the arch portion sums the acoustical energy transmitted through the coupling members; and wherein the transducer means include a drive stud which is coupled at one end to the arch portion;

a piezoelectric element which is supported by the base means for contact with the free end of the drive stud; so that the summed acoustical energy in the arch portion is coupled to the piezoelectric element by way of the drive stud.

* * * * *